US007258551B2

(12) United States Patent
Minich

(10) Patent No.: US 7,258,551 B2
(45) Date of Patent: Aug. 21, 2007

(54) ELECTRICAL CONNECTOR STRESS RELIEF AT SUBSTRATE INTERFACE

(75) Inventor: Steven E. Minich, York, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/193,765

(22) Filed: Jul. 29, 2005

(65) Prior Publication Data

US 2007/0026743 A1 Feb. 1, 2007

(51) Int. Cl.
*H01R 12/00* (2006.01)

(52) U.S. Cl. ..... 439/67

(58) Field of Classification Search ..... 439/67, 439/82, 492, 493; 361/784
See application file for complete search history.

(56) References Cited

U.S. PATENT DOCUMENTS 4,072,376 A * 2/1978 Shannon ..... 439/590
4,815,987 A * 3/1989 Kawano et al. ..... 439/263
4,880,388 A * 11/1989 Beamenderfer et al. .... 439/108
5,330,365 A * 7/1994 Leeson ..... 439/77
5,947,764 A * 9/1999 Pan et al. ..... 439/492
6,033,234 A * 3/2000 Wang et al. ..... 439/67
6,135,791 A 10/2000 Wang et al. ..... 439/83
6,302,705 B1 * 10/2001 Yatskov et al. ..... 439/67
6,368,116 B1 * 4/2002 Tabata et al. ..... 439/67
6,461,202 B2 * 10/2002 Kline ..... 439/701
6,524,115 B1 2/2003 Gates et al. ..... 439/66
6,527,597 B1 3/2003 Harper, Jr. ..... 439/701
6,816,385 B1 11/2004 Alcoe ..... 361/767
6,997,720 B2 * 2/2006 Perret et al. ..... 439/67
2002/0063318 A1 5/2002 Mitchell et al. ..... 257/678
2003/0092293 A1 * 5/2003 Ohtsuki et al. ..... 439/66
2003/0220021 A1 * 11/2003 Whiteman et al. ..... 439/608
2004/0086026 A1 * 5/2004 Miki et al. ..... 374/183
2005/0266741 A1 * 12/2005 Miyamoto et al. ..... 439/862

* cited by examiner

*Primary Examiner*—Chandrika Prasad
(74) *Attorney, Agent, or Firm*—Woodcock Washburn LLP

(57) ABSTRACT

An electrical connector includes a wafer having flexible members that allow the wafer to expand or contract in response to movement of solder pads on a PCB. As a PCB to which a connector is attached is heated during, for example, normal use, it may expand, which may result in the outward movement of the solder balls at the point of connection with the PCB. The flexible members in the wafer enable the wafer to likewise expand so that it does not impede the movement of the solder connections and cause a stress to be placed on the solder connections at the PCB connection point.

24 Claims, 8 Drawing Sheets

ELECTRICAL CONNECTOR STRESS RELIEF AT SUBSTRATE INTERFACE

CROSS-REFERENCE TO RELATED APPLICATIONS

The subject matter disclosed herein is related to the subject matter disclosed and claimed in U.S. patent application having Ser. No. 10/940,433 filed Sep. 14, 2004, entitled "Ball Grid Array Connector" (now U.S. Pat. No. 7,214,104) which is assigned to the assignee of the present application and hereby incorporated herein by reference in its entirety. The subject matter disclosed herein is related to the subject matter disclosed in provisional U.S. patent application having Ser. No. 60/648,561, filed Jan. 31, 2005, entitled "Surface-Mount Connector" which is assigned to the assignee of the present application and hereby incorporated herein by reference in its entirety.

FIELD OF THE INVENTION

Generally, the invention relates to electrical connectors. More particularly, the invention relates to connectors that allow for relative movement of contacts connected to a substrate.

BACKGROUND OF THE INVENTION

Substrates such as printed circuit boards ("PCBs") are commonly used to mount electronic components and to provide electrical interconnections between those components and components external to the PCB. During use of a connector, the connector and the PCB may be heated, causing each to expand. The rate of expansion of the connector may be different from the rate of expansion of the PCB. This difference may result in strain being placed at the point of connection of the connector to the PCB. For example, a connector may be mounted to a circuit board through the use of solder balls that are attached to connector contacts and soldered to the PCB. As the PCB and connector are heated or cooled during operation, the connector may expand to a greater or lesser degree than the PCB, resulting in a stress being placed on one or more contact solder joints at the PCB. The stress may break one or more soldered connections and result in degradation of electrical connectivity between the connector and PCB. Similar problems may be encountered when contacts are in a press-fit engagement with a PCB.

SUMMARY OF THE INVENTION

An electrical connector according to the invention may include a wafer that has apertures through which contacts of the connector extend. The wafer, for example, may be contained within the connector between one or more lead frame assemblies and solder balls attached to contacts extending from the lead frame assemblies. The wafer may include one or more flexible members that allow the wafer to expand or contract in response to movement of solder pads on a printed circuit board. The contacts may move when the connector from which the contacts extend expands at a greater or lesser rate than the PCB. For example, as the PCB is heated, it may expand which may result in the movement of the solder pads. The flexible members in the wafer may enable the wafer to likewise expand or contract relative to the PCB so that it does not impede the movement of the solder balls and cause a stress to be placed on the solder balls at the PCB connection point.

The flexible members may be arranged in a linear array such that the wafer expands and contracts in directions parallel to a direction in which the lead frame assemblies extend. Alternatively, the flexible members may be arranged in a linear array such that the wafer expands and contracts in directions orthogonal to a direction in which the lead frame assemblies extend.

DETAILED DESCRIPTION OF ILLUSTRATIVE EMBODIMENTS

Figure 1B:
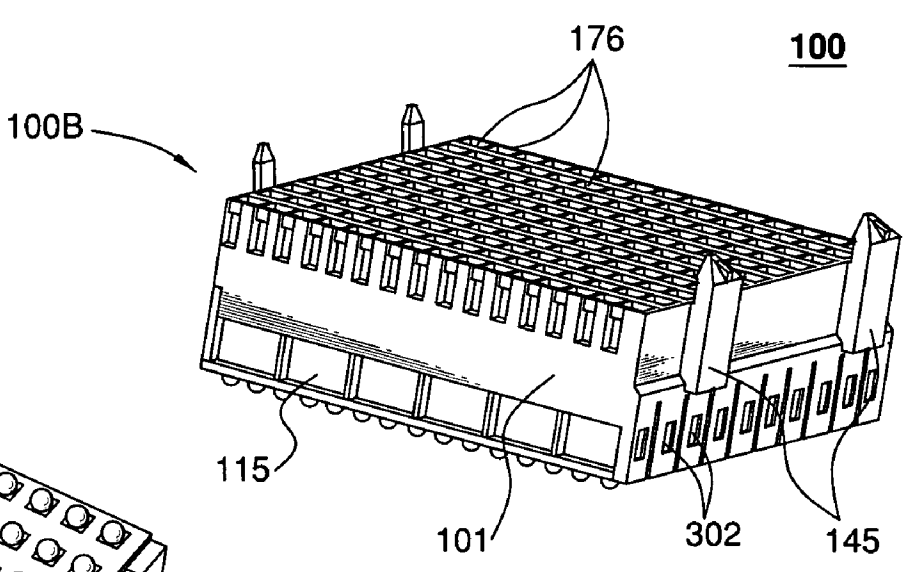
FIGS. 1A and 1B depict an example embodiment of an electrical connector according to the invention.
Figure 1A:
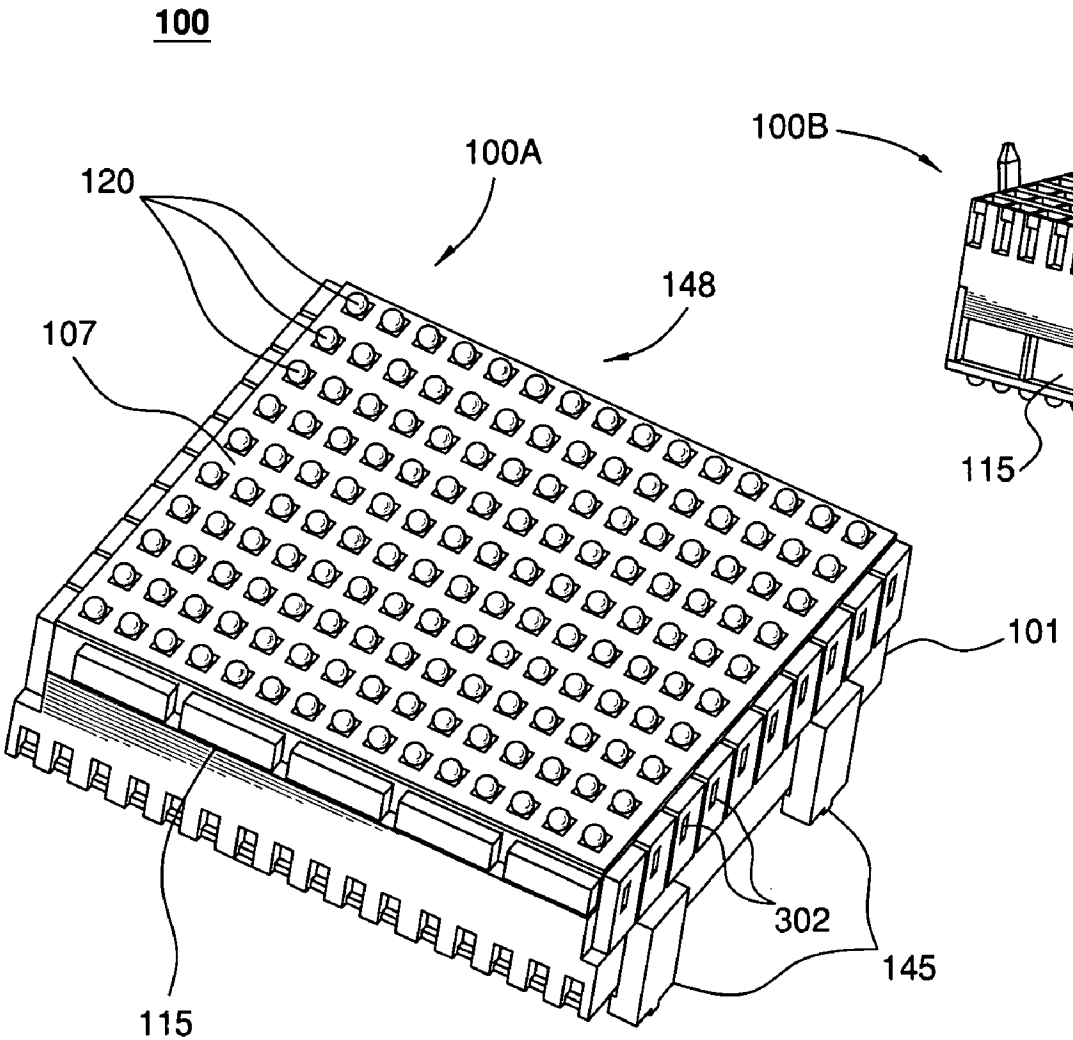

FIGS. 1A and 1B depict an example embodiment of a ball grid array ("BGA") connector 100 according to the invention having a ball grid side 100A (best seen in FIG. 1A) and a receptacle side 100B (best seen in FIG. 1B). Though the connector described herein is depicted as a ball grid array connector, it should be understood that through pin mounting or surface mounting other than BGA may also be used. As shown, the BGA connector 100 may include a housing 101, which may be made of an electrically insulating material, such as a plastic, for example, that defines an internal cavity. The housing 101 may contain one or more insert molded lead frame assemblies ("IMLAs") 115. In an example embodiment, the housing 101 may contain ten IMLAs 115, though it should be understood that the housing 101 may contain any number of IMLAs 115.

Figure 2:
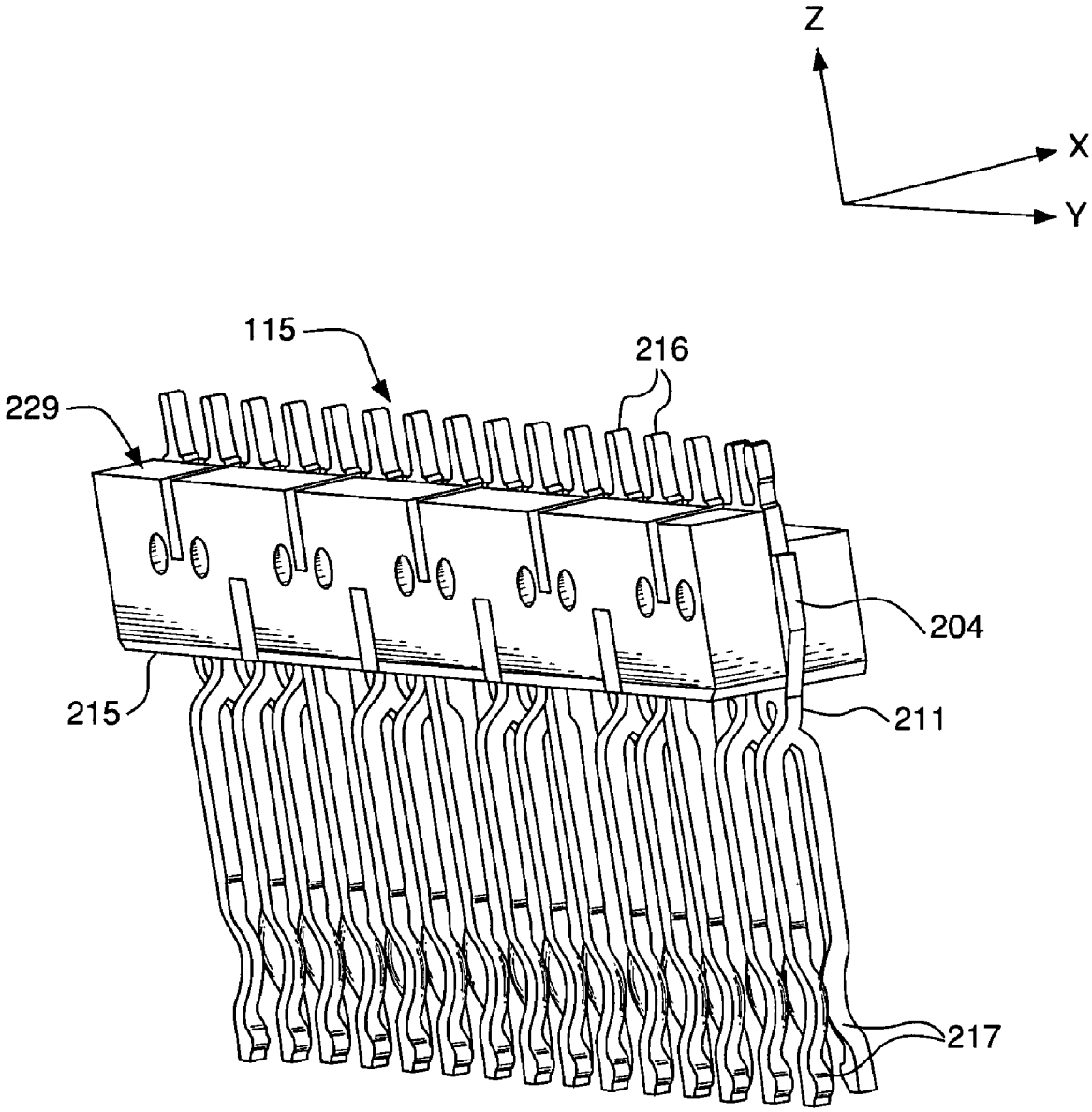
FIG. 2 depicts an example embodiment of an insert molded lead frame assembly according to the invention.

FIG. 2 depicts an example embodiment of an IMLA 115. As shown, the IMLA 115 may include a set of one or more electrically conductive contacts 211 that extend through an overmolded housing 215. The overmolded housing 215 may be made of an electrically insulating material, such as a plastic, for example. Adjacent contacts 211 that form a differential signal pair may jog toward or away from each other as they extend through the overmolded housing 215 in order to maintain a substantially constant differential impedance profile between the contacts that form the pair. For arrangement into columns, the contacts 211 may be disposed along a length of the overmolded housing 215 (e.g., along the "Y" direction as shown in FIG. 2). The length of the overmolded housing 215 extending in the "Y" direction is longer than the length of the overmolded housing 215 extending in either the "X" or "Z" directions. The length extending in the "Y" direction is hereinafter referred to as "the lead frame direction." That is, "the lead frame direction" is extending on its longest axis (e.g., the "Y" axis).

The contacts 211 may be dual beam receptacle contacts, for example. Such a dual beam receptacle contact may be adapted to receive a complementary beam contact during mating with an electrical device. As shown in FIG. 2, each contact 211 may have a dual beam receptacle portion 217 and a terminal portion 216. The terminal portion 216 may be adapted to receive a solder ball 120 as described below.

An IMLA 115 may also include one or more containment tabs 204. In an example embodiment, a respective tab 204 may be disposed on each end of the IMLA 115. For example, the contact 211 at the end of the IMLA 115 may have a tab 204 that extends beyond a face of the overmolded housing 215. In such an embodiment, the tab 204 may be made of the same material as the contact 211 (e.g., electrically conductive material). Alternatively, the tabs 204 may extend from the overmolded housing 215, and may be attached to the overmolded housing 215 or integrally formed with the overmolded housing 215. In such an embodiment, the tab 204 may be made of the same material as the overmolded housing 215 (e.g., electrically insulating material).

Figure 3:
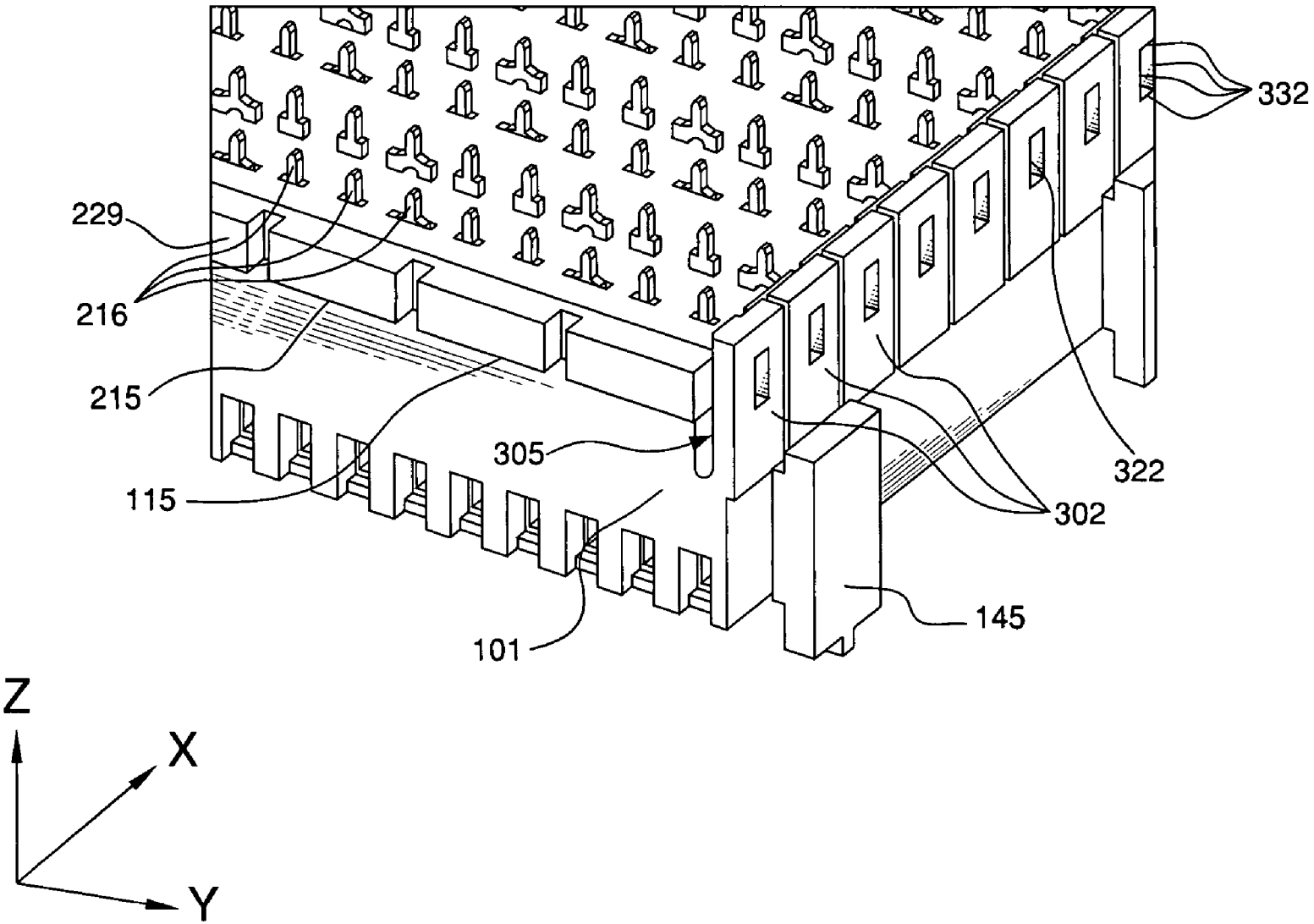
FIG. 3 provides a partial view of an example embodiment of a ball grid array connector according to the invention, without a wafer or solder balls.

As best seen in FIG. 3, the connector housing 101 may include one or more tab receptacles 302. In an example embodiment, a respective pair of tab receptacles 302 are arranged on opposite sides of the housing 101 to contain an associated IMLA 115 in a first direction (such as the Y-direction shown in FIG. 3). Each tab receptacle 302 may have an opening 322 for receiving a respective tab 204. Each such opening may be defined by a plurality of faces 332 formed within the tab receptacle. The tab receptacles 302 may be resilient so that they may be displaced enough to insert the associated IMLA 115 into the housing 101. With the IMLA 115 inserted into the housing 101, the tab receptacle 204 may snap back, and thus, the tabs 204 may be set within the openings 322 in the tab receptacles 302. According to an aspect of the invention, the tab receptacles 302 may contain the IMLAs within the housing in all directions, and also allow for movement of the IMLAs 115 in all directions within the housing.

To allow movement of the IMLAs 115 in the Y-direction, the lead frames 215 need not extend all the way to the inner surface 305 of the tab receptacle 302. When an end of the overmolded housing 215 meets the inner surface 305 of the associated tab receptacle 302, the tab receptacle 302 prevents the overmolded housing 215 from moving any further in the Y-direction. The distance the IMLA 115 may move relative to the housing 101 in the Y-direction may be controlled by regulating the distance between the end of the overmolded housing 215 and the inner surface 305 of the housing 101. Thus, the tab receptacles 302 may contain the IMLAs 115 in the Y-direction within the housing 101, while allowing movement of the IMLAs in the Y-direction.

To allow movement of the IMLA 115 relative to the housing 101 in the X- and Z-directions, the receptacle openings 322 may be made slightly larger than the cross-section (in the X-Z plane) of the tabs 204 that the openings 322 are adapted to receive. When the tab 204 meets one of the faces 332, the face 332 prevents the tab 204 (and, therefore, the overmolded housing 215) from moving any farther in whichever direction the IMLA 115 is moving (e.g., the X- or Z-direction). The relative difference in size between the receptacle opening 322 and the cross-section of the tab 204 determines the amount the IMLA 115 may move relative to the housing 101 in the X- and Z-directions. Thus, the tab receptacles 302 may contain the IMLAs 115 in the X- and Z-directions, while allowing movement of the IMLAs in the X-Z plane.

In an example embodiment of the invention, the tabs 204 may have dimensions of about 0.20 mm in the X-direction and about 1.30 mm in the Z-direction. The receptacle openings 322 may have dimensions of about 0.23 mm in the X-direction and about 1.45 mm in the Z-direction. The distance between each end of the overmolded housing 215 and the respective inner surface 305 of the housing 101 may be about 0.3 mm.

As shown in FIGS. 1A and 1B, a connector 100 according to the invention may include a ball grid array 148. The ball grid array 148 may be formed by forming a respective solder ball 120 on the terminal end 216 of each of the electrical contacts 211. Thus, the ball grid array connector 100 may be set on a substrate, such as a printed circuit board, for example, having a pad array that is complementary to the ball grid array 148.

According to an aspect of the invention, the connector 100 may include a contact receiving substrate or wafer 107 that contains the terminal ends of the contacts, while allowing for movement of the terminal ends. The wafer 107 may be made of an electrically insulating material, such as a plastic, for example.

Figure 4:
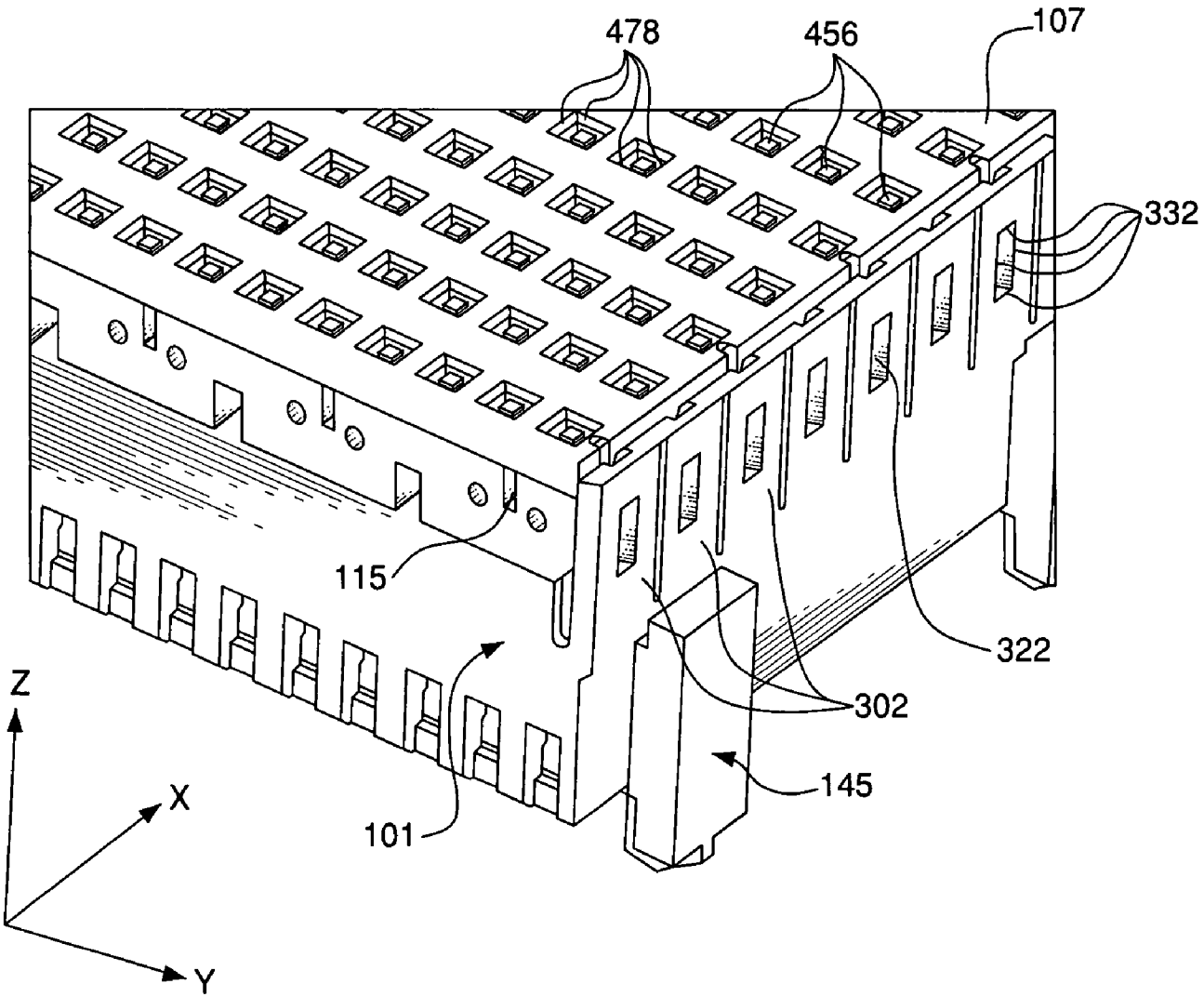
FIG. 4 provides a partial view of an example embodiment of a ball grid array connector according to the invention, without solder balls.

As best seen in FIG. 4, the wafer 107 may include an array of apertures 456. Each aperture 456 may receive a respective terminal portion 216 of a respective contact 211. Each aperture 456 is defined by a respective set of faces 478 that contain the terminals in the X- and Y-directions. To allow movement of the terminals in the X- and Y-directions, the apertures 456 may be slightly larger than the cross-section (in the X-Y plane) of the terminals 216 that the apertures 456 are adapted to receive. As shown, the faces 478 may define the aperture 456 such that at least one of the faces has a length that is greater than the width of the contact. Thus, the terminal portion of the contact may sit freely, or "float," within the aperture 456. That is, the terminal portion of the contact need not necessarily touch any of the faces that define the aperture 456. The relative difference in size between the aperture 456 and the terminal 216 determines the amount the terminal may move in the X- and Y-directions. Thus, the wafer 107 may contain the terminal portions 216 of the contacts 211 in the X- and Z-directions, while allowing movement of the terminal portions 216 in the X-Y plane.

As shown, the apertures 456 may be generally rectangular, though it should be understood that the apertures 456 may be defined to have any desired shape. In an example embodiment of the invention, the terminal portions 216 of the contacts 211 may have dimensions of about 0.2 mm by about 0.3 mm. The apertures 456 may have dimensions of about 0.6 mm by about 0.6 mm.

Figure 5:
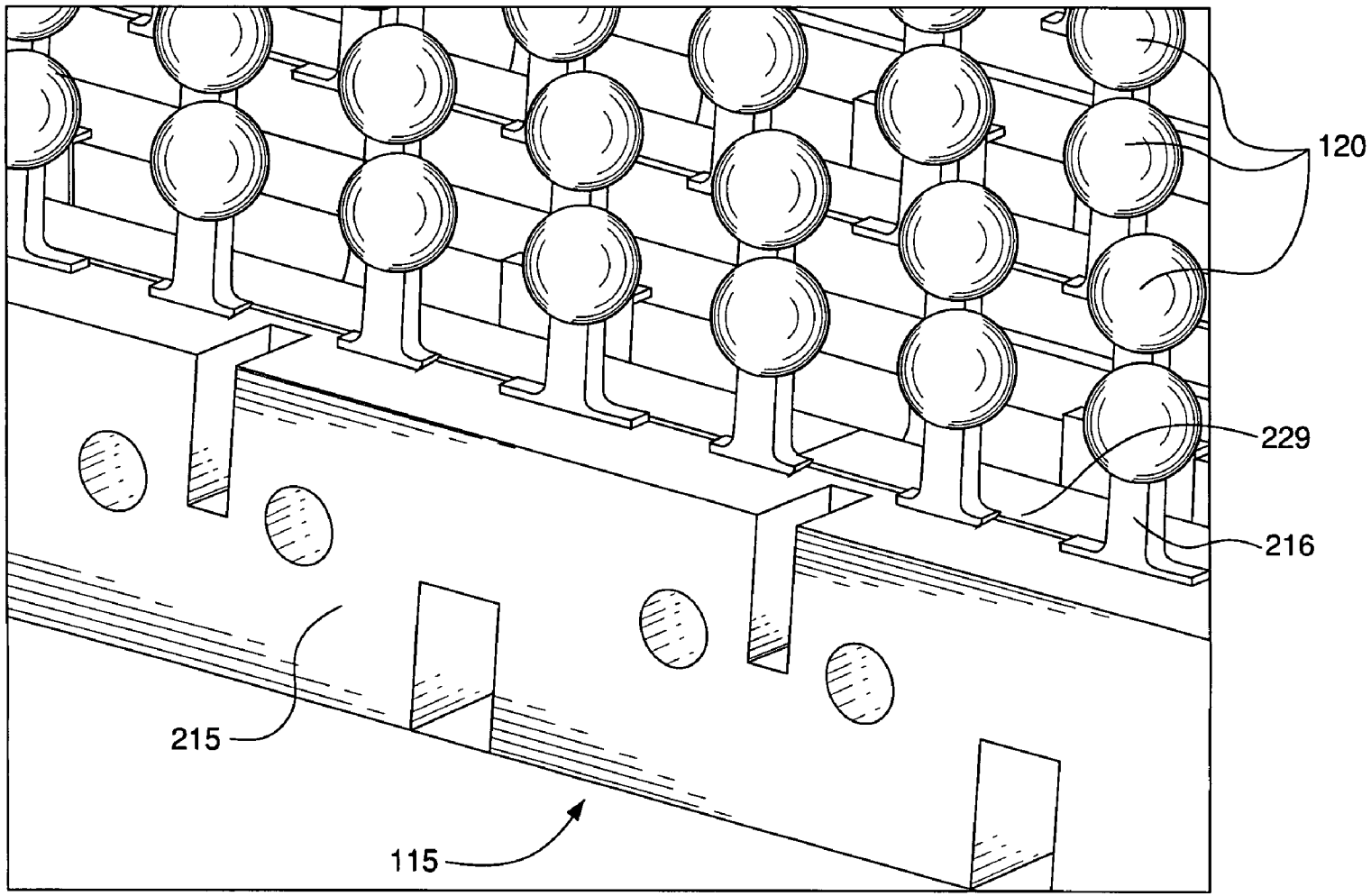
FIG. 5 provides a partial view of a ball grid array formed on a plurality of electrical contacts, without a wafer.

To manufacture the connector 100, the IMLAs 115 may be inserted and latched into the housing 101 as described above. The wafer 107 may then be set on the ball-side faces 229 of the overmolded housing 215, with the terminal portions 216 of the contacts 211 extending into the apertures 456. Respective solder balls 120 may then be formed on the terminal portions 216 of the contacts 211 using known techniques. FIG. 5 depicts a plurality of solder balls 120 formed on respective terminal portions 216 of contacts 211 that extend through overmolded housing 215. Note that FIG. 5 depicts the connector with solder balls 120 but without the wafer 107, though it is contemplated that the wafer 107 will be set onto the lead frames before the solder balls 120 are formed.

To form a solder ball 120 on a terminal portion 216 of a contact 211, solder paste may be deposited into the aperture 456 into which the terminal portion 216 of the contact 211 extends. A solder ball 120 may be pressed into the solder paste against the surface of the wafer 107. To prevent the contact 211 from being pulled into the housing through the aperture, the diameter of the solder ball 120 may be greater than the width of the aperture 456. The connector assembly (which includes at least the contact 211 in combination with the housing 101 and the wafer 107) may be heated to a temperature that is greater than the liquidous temperature of the solder. This causes the solder to reflow, form a generally spherically shaped solder mass on the contact terminal portion 216, and metallurgically bond the solder ball 120 to the contact 211.

Preferably, the aperture 456 has a width that is less than the diameter of the solder ball 120 so that the solder ball 120 prevents the contact 211 from being able to be pulled into the housing 101. Similarly, the diameter of the solder ball 120 being greater than the width of the aperture 456 enables the wafer 107 to be contained between the solder balls 120 and the overmolded housings 215 of the IMLAs 115.

Figure 6:
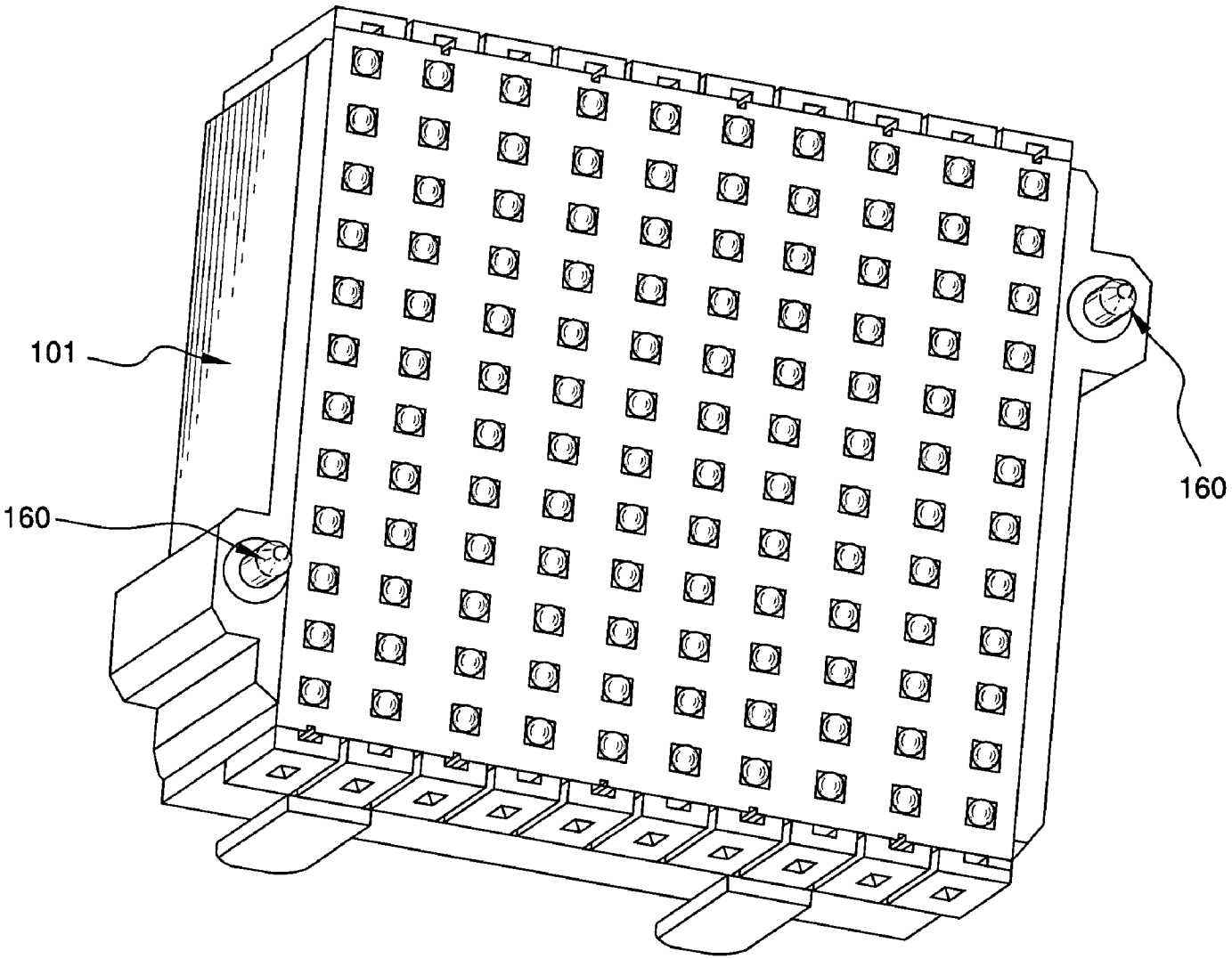
FIG. 6 provides a perspective bottom view of a connector according to the invention with solder posts attached to a housing.

As shown in FIG. 6, the connector housing 101 may also include one or more solder posts 160. The solder posts 160, which may contain solder or solderable surfaces, may be adapted to be received in orifices defined by a PCB board.

The IMLAs 115 may be free to move with respect to the housing 101, as described above, prior to reflow of the solder balls 120. This movement, or float, allows the IMLAs 115 to self-align during reflow of the solder balls 120. For example, when the solder balls 120 liquefy during reflow, surface tension in the liquid solder produces a self-aligning effect. The present invention allows the IMLAs 115 to benefit from the self-aligning properties of the liquid solder balls 120. Once reflow is complete, the contacts 211, housing 101, and solder posts 160 are fixed with respect to the PCB. The affixed solder posts 160 help prevent forces acting on the housing 101, in a direction parallel to the PCB, to transmit to the solder balls 120.

Figure 8:
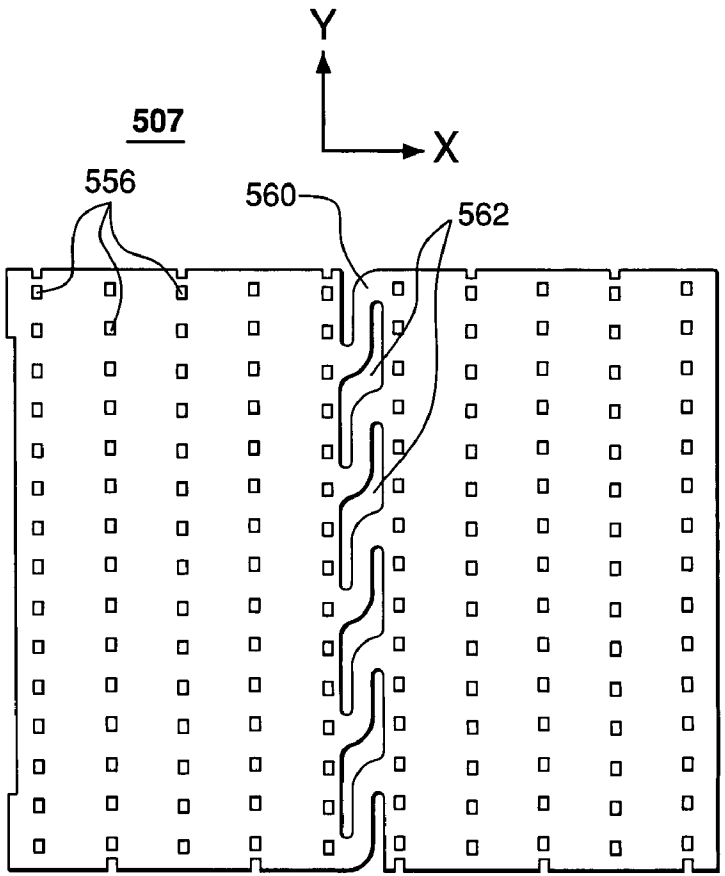
FIG. 8 provides a top view of an example alternative embodiment of a wafer according to the invention.
Figure 7:
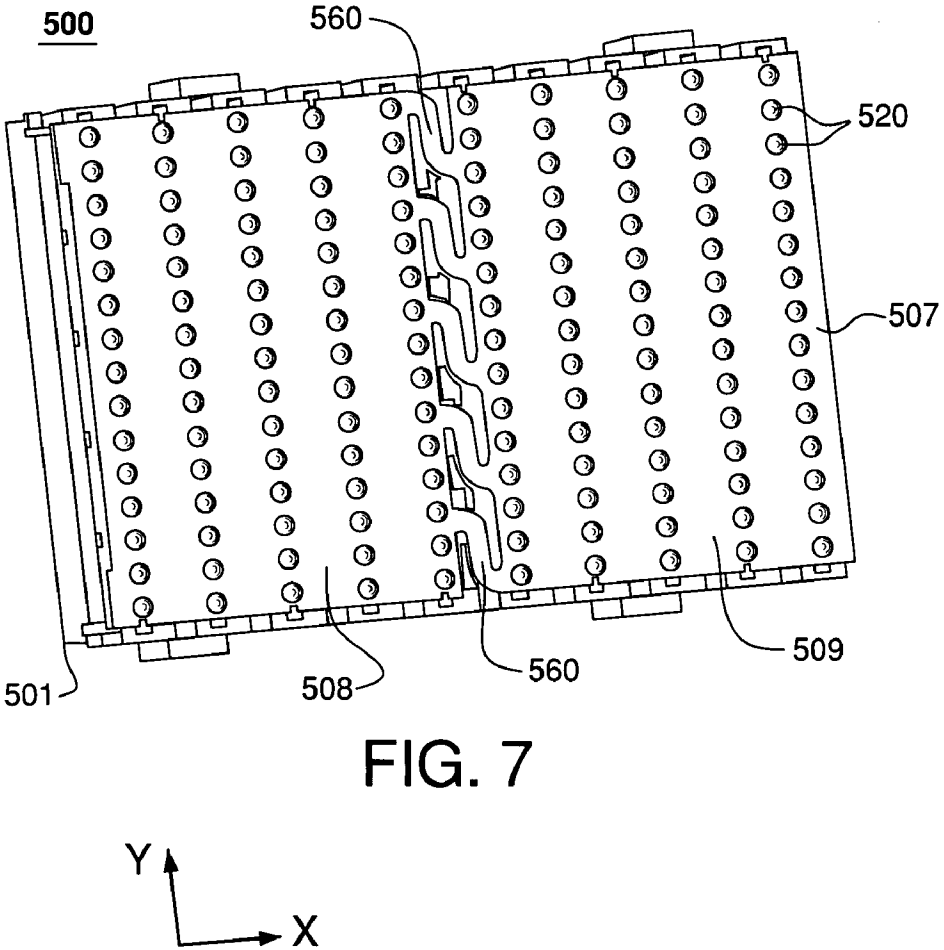
FIG. 7 provides a perspective view of an example alternative embodiment of a BGA connector according to the invention.

FIG. 7 provides a perspective view of an example alternative embodiment of a BGA connector 500 according to the invention. FIG. 8 provides a top view of an example alternative embodiment of a wafer 507 according to the invention. The connector 500 is shown from a ball grid array side. Though the connector 500 described herein is depicted as a BGA connector, it should be understood that through pin mounting or surface mounting other than BGA may also be used. The connector 500 may include a housing 501, one or more IMLAs or stitched contacts (not shown), and a contact receiving substrate or wafer 507. The wafer 507 may contain terminal ends of contacts, such as the terminal portions 216 of the contacts 211 described herein, while allowing for movement of the solder pads. The wafer 507 may be made of an electrically insulating material, such as plastic, for example.

As best seen in FIG. 8, the wafer 507 may include an array of contact receiving apertures 556 similar to the apertures 456 described herein with regard to the wafer 107. To allow relative movement of terminal ends of contacts during reflow of the connector to the PCB, the contact receiving apertures 556 may be slightly larger than the cross-section of the terminal ends of the contacts that the apertures 556 are adapted to receive. Thus, the terminal portion of each contact may sit freely or "float" within respective apertures 556. As shown, the apertures 556 may be generally rectangular, though it should be understood that the apertures 556 may be defined to have any desired shape.

As described with regard to the wafer 107, IMLAs or other surface mount contact tails may be inserted on the housing 501, and the wafer 507 may be set on the overmolded housings of the IMLAs with the terminal portions of the contacts extending into the apertures 556. Respective solder balls 520 may then be formed on the terminal portions of the contacts.

The wafer 507 may include a linear array of flexible members 560 extending in the Y-direction (as shown with regard to FIG. 8), that is, in a direction that is generally parallel with the lead frame direction of the IMLAs. As described with regard to FIG. 2, "the lead frame direction" refers to the direction in which the overmolded housing of the IMLA extends on its longest axis (e.g., the "Y" axis or along the "Y" direction). The wafer 507 may be in a rectangular shape, with two short parallel sides extending in the lead frame direction (the Y-direction) and two long parallel sides extending orthogonal to the lead frame direction (the X-direction).

The linear array of flexible members 560 may partition the wafer 507 in the X-direction, orthogonal to the lead frame direction, into two wafer body portions 508, 509. That is, the flexible members 560 may partition the wafer 507 in its longest direction. The flexible members 560 may be of any desired shape and size. In the example embodiment depicted in FIGS. 7 and 8, five flexible members 560 are each in a generally "S" shape. The wafer 507 may define flex creating apertures 562 of appropriate shapes and sizes to create the flexible members 560.

The removal of material of the wafer 507 in defining the flex creating apertures 562, in addition to the shape of the apertures 562 and the shape of the corresponding flexible members 560, may provide the ability of the wafer 507 to respond to PCB movement. That is, the shape of the flexible members 560 (or the shape of the flex creating apertures 562) may enable the wafer portions 508, 509 to move generally in the X-direction, expanding or contracting the wafer 507.

Such ability to expand or contract may relieve stress that may otherwise be placed on solder balls 120 connected to a PCB. Such stress may be caused by temperature fluctuations, for example, during normal use of the PCB/connector system. The temperature fluctuations may cause stress because of mismatches in coefficient of thermal expansion (CTE) between the connector 500 or portions of the connector 500 and a PCB to which the connector 500 is connected. For example, as the connector 500 and PCB are heated during normal use, the connector 500 may expand in the X-direction more rapidly than the PCB. The solder balls/connections 120 may not move or may move outwardly more slowly than the remainder of the solder connections that extend from the IMLA. Also for example, as the connector 500 and PCB are heated during normal use, the PCB may expand in the X-direction more rapidly that the connector 500 and thus the solder balls 120 may move more rapidly than the remainder of the solder balls 120 that extend from the IMLA. Conversely, as the connector 500 and PCB cool, each may contract at a rate different from the other, causing relative movement between the connector 500 and PCB solder connections. The flexible members 560 may respond to solder ball movement 120, allowing the wafer 560 to expand or contract as the solder pads on the PCB move. Such expansion or contraction may help prevent placing stress on the solder balls 120 at the point of connection with the PCB. Allowing the wafer 507 to expand and contract thus may help reduce stresses on the PCB connections and extend the functional life of the connector 500 despite thermal cycling.

It should be understood that the flexible members 560 may be shaped, sized, and oriented to enable the wafer 507 to expand or contract in the Y-direction, that is, parallel to the lead frame direction, or in a combination of X- and Y-directions. Additionally, it will be understood that, though the wafer 507 includes five flexible members 560 in a linear array (and defines six flexible creating apertures 562) any number of flexible members 560 or apertures 562 may be used to relieve stress, and alternative embodiments are envisioned in which flexible members 560 and apertures 562 are of different shapes and sizes and extend in arrangements other than in linear arrays. It will also be understood that the thickness of the flexible members 560 may be less or more than the thickness of the wafer 507. Further, use of more than one linear array is also envisioned.

Figure 9:
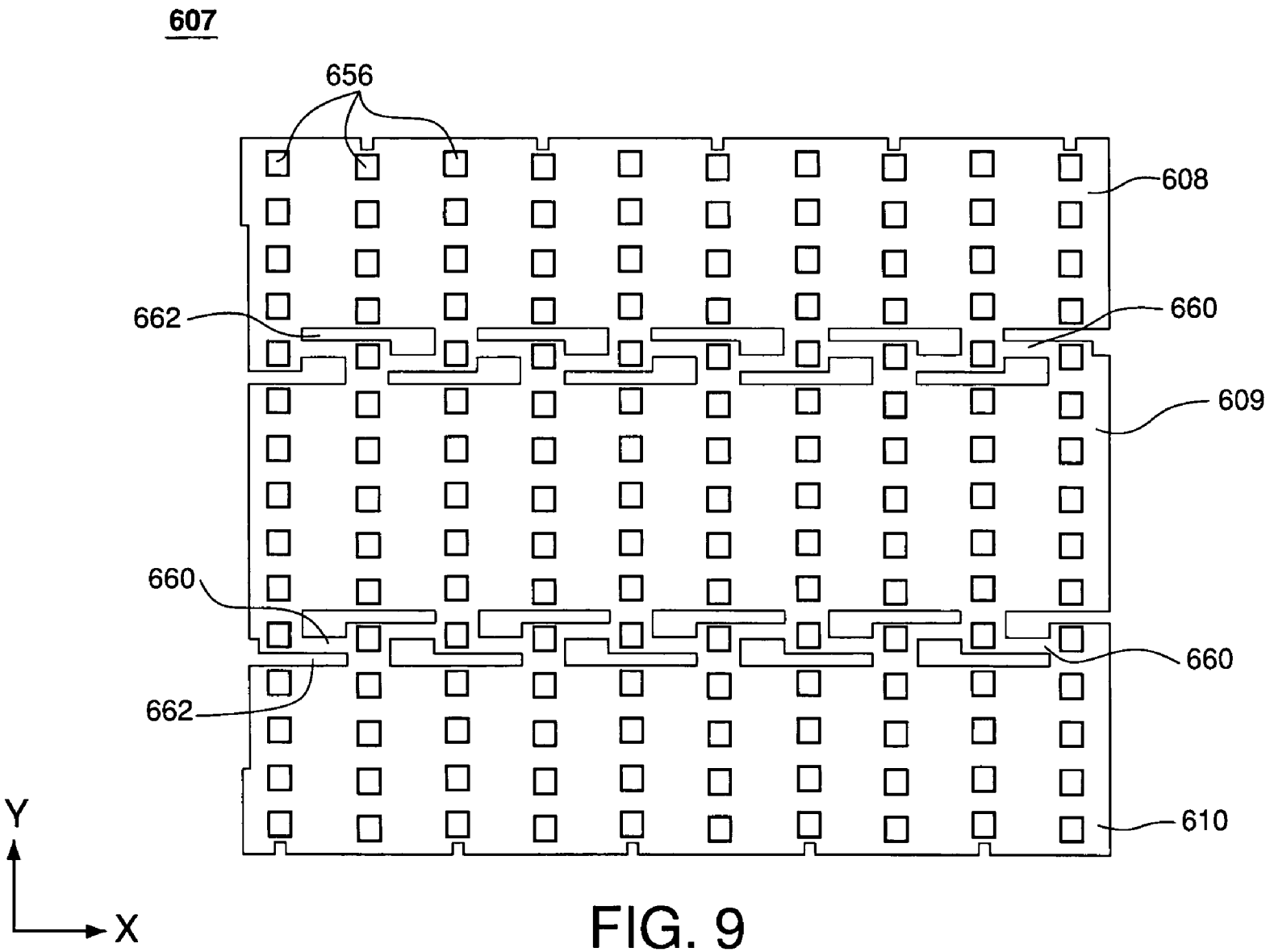
FIG. 9 provides a top view of another example embodiment of a wafer according to the invention.

FIG. 9 provides a top view of an alternative example wafer 607, according to the invention. The wafer 607 may include an array of contact receiving apertures 656 similar to the apertures 556 described herein with regard to the wafer 507. To allow movement of terminal ends of contacts during reflow of the connector to a PCB, the apertures 656 may be slightly larger than the cross-section of the terminal ends of the contacts that the apertures 656 are adapted to receive. Thus the terminal portion of each contact may sit freely or "float" within the aperture 656. As shown, the apertures 656 may be generally rectangular, though it should be understood that the apertures 656 may be defined to have any desired shape.

As described with regard to the wafer 507, the wafer 607 may be disposed to be set on a housing or overmolded housings of IMLAs of a connector, with terminal portions of IMLA contacts extending into the apertures 656. The lead frame direction may be in the "Y" direction as shown in FIG. 9. Respective solder balls may then be formed on the terminal portions of the contacts to contain the wafer 607.

The wafer 607 may be in a rectangle shape, with two short parallel sides extending in the lead frame direction (the Y-direction) and two long parallel sides extending orthogonal to the lead frame direction (the X-direction).

The wafer 607 may include two linear arrays of flexible members 660 extending in the X-direction, orthogonal to the lead frame direction. The linear arrays of flexible members 660 may partition the wafer 607 in its shorter Y-direction into to three sections 608, 609, 610. The flexible members 660 may be of any appropriate shape and size. In the example embodiment depicted in FIG. 9, the flexible members 660 may be generally "L" shaped. The wafer 607 may define flex creating apertures 662 of appropriate shapes and sizes to create the flexible members 560.

The removal of material of the wafer 607 in defining the flex creating apertures 662, in addition to the shape of the apertures 662 and corresponding shape of the flexible members 660, may provide the ability of the wafer 607 to respond to solder connection movement. That is, the shape of the flexible members 660 (or the shape of the flex creating apertures 662) may enable the wafer portions 608, 609, 610 to move generally in the Y-direction, expanding or contracting the wafer 607. A flexible member 660 may be responsive to a shear force exerted, at least in part, parallel to the Y-direction that tends to bend or pull the "L" shaped member 660. The "L" shaped flexible member 660 may be responsive to such a shear force, enabling the wafer 607 to be generally responsive to expansion forces exerted, for example, by movement of the solder pads. Each flexible member 660 may additionally be responsive to a shear force exerted, at least in part, parallel to the Y-direction that tends to compress the "L" shape. The "L" shaped flexible member 660 may be responsive to compression forces, enabling the wafer 607 to be responsive to contraction forces exerted by movement of the solder pads.

Such ability to expand or contract may relieve stress that may otherwise be placed on solder balls or solder connections of an electrical connector connected to a PCB. Such stress may be caused by temperature fluctuations during normal use of the PCB/connector system. The temperature fluctuations may cause stress because of CTE mismatches between the solder balls 120 and the solder pads of the PCB. Allowing the wafer 607 to expand and contract may help reduce stresses on PCB connections and extend the functional life of the connector despite thermal cycling.

It will be understood that any number of linear arrays of flexible members 660 or flex creating apertures 662 may be used to relieve stress, and alternative embodiments are envisioned in which flexible members 660 or flex creating apertures 662 are of different shapes and sizes and extend in arrangements other than in linear arrays. It will also be understood that the thickness of the flexible members 660 may be less or more than the thickness of the wafer 607.

It is to be understood that the foregoing illustrative embodiments have been provided merely for the purpose of explanation and are in no way to be construed as limiting of the invention. Words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods, and uses, such as are within the scope of the appended claims. Those skilled in the art, having the benefit of the teachings of this specification, may affect numerous modifications thereto and changes may be made without departing from the scope and spirit of the invention in its aspects.

What is claimed:

1. An electrical connector comprising:

a connector housing;

a lead frame assembly contained in the connector housing, the lead frame assembly comprising a dielectric lead frame housing and an electrical contact extending from the lead frame housing; and a wafer defining a contact receiving aperture, wherein the electrical contact extends into the contact receiving aperture, the wafer comprising, a first rigid body portion and a second rigid body portion, and a flexible member partially defining at least one flex creating aperture and partitioning at least part of the first and second body portions, wherein the flexible member enables movement of at least one of the first and second body portions relative to one another.

2. The electrical connector of claim 1, wherein the flexible member enables movement of the first body portion in a first direction and the second body portion in a second direction.

3. The electrical connector of claim 2, wherein the first direction is opposite the second direction.

4. The electrical connector of claim 2, wherein the lead frame assembly extends in a lead frame direction, and wherein at least one of the first and second directions is parallel to the lead frame direction.

5. The electrical connector of claim 2, wherein the lead frame assembly extends in a lead frame direction, and wherein at least one of the first and second directions is orthogonal to the lead frame direction.

6. The electrical connector of claim 2, wherein the wafer is rectangular, and wherein at least one of the first and second directions is parallel to a long side of the wafer.

7. The electrical connector of claim 2, wherein the wafer is rectangular, and wherein at least one of the first and second directions is orthogonal to a long side of the wafer.

8. The electrical connector of claim 1, wherein at least one of the first and second body portions moves in response to a temperature change.

9. The electrical connector of claim 1, wherein at least one of the first and second body portions moves in response to movement of the electrical contact.

10. The electrical connector of claim 1, wherein the flexible member is "S" shaped.

11. The electrical connector of claim 1, wherein the flexible member is "L" shaped.

12. A wafer for an electrical connector, comprising:

a first rigid planar body portion and a second rigid planar body portion, each defining a respective contact-receiving aperture for receiving a terminal end of an electrical contact, said first and second body portions adjacent to one another in a first direction; and a linear array of flexible members connecting the first and second planar body portions to one another and defining a linear array of flex creating apertures, the linear array of flexible members and the linear array of flex creating apertures extending along a second direction that is orthogonal to the first direction, wherein each of the flex creating apertures is defined, at least in part, by two adjacent flexible members, and wherein the array of flexible members enables at least one of the first and second planar body portions to move relative to the other.

13. The wafer of claim 12, wherein the first and second planar body portions are adapted to be contained in the electrical connector at least in part by inserting a respective electrical contact through the each of contact-receiving apertures and attaching a respective solder ball to a respective terminal each of the electrical contacts.

14. The wafer of claim 12, wherein the linear array of flexible members is disposed to enable the first and second planar body portions to expand or contract in the first direction.

15. The wafer of claim 12, wherein the linear array of flexible members is disposed to enable the first and second planar body portions to expand or contract in the second direction.

16. The wafer of claim 12, wherein the linear array of flexible members enables at least one of the first and second planar body portions to move in response to movement of one or more of the electrical contacts.

17. An electrical connector, comprising:

a lead frame assembly comprising a dielectric lead frame housing and an electrical contact partially extending from the lead frame housing;

a connector housing containing the lead frame assembly;

a solder ball attached to the electrical contact; and a wafer contained between the solder ball and the lead frame assembly, the wafer defining a contact receiving aperture, a linear array of flex creating apertures and a linear array of flexible members, the linear array of flexible members and the linear array of flex creating apertures extending along a length of the wafer and partitioning the wafer into at least two portions, wherein the contact is at least partially inserted into the contact receiving aperture, and wherein the linear array of flexible members and the linear array of flex creating apertures enables at least one of the portions of the wafer to move relative to the lead frame assembly.

18. The electrical connector of claim 17, wherein the linear array of flexible members extends in an array direction, wherein the linear array of flexible members and the linear array of flex creating apertures at least in part enables at least one of the portions of the wafer to move in a direction orthogonal to the array direction.

19. The electrical connector of claim 18, wherein the lead frame assembly extends in a direction parallel to the array direction.

20. The electrical connector of claim 18, wherein the lead frame assembly extends in a direction orthogonal to the array direction.

21. The electrical connector of claim 1, further comprising a plurality of flexible members positioned between the first and second body portions and physically separate the first and second body portions from one another.

22. The electrical connector of claim 1, wherein the flexible member enables the wafer to expand and contract.

23. The wafer of claim 18, wherein the linear array of flexible members enable the wafer to expand in a direction orthogonal to the array direction.

24. The wafer of claim 18, wherein the linear array of flexible members enable the wafer to contract in a direction orthogonal to the array direction.

* * * * *